United States Patent [19]

Libit

[11] Patent Number: 4,674,192

[45] Date of Patent: Jun. 23, 1987

[54] ACCOUNTING GUIDE

[76] Inventor: Jeanne E. Libit, 2119C N. Monroe St., Arlington, Va. 22207

[21] Appl. No.: 825,569

[22] Filed: Feb. 3, 1986

[51] Int. Cl.[4] ..... B43L 7/06; B43L 13/00

[52] U.S. Cl. ..... 33/477; 33/478; 434/109

[58] Field of Search ..... 33/479, 480, 478, 474, 33/1 B, 1 C, 477, 493; 434/109

[56] References Cited

U.S. PATENT DOCUMENTS

| | | | |
|---|---|---|---|
| 2,078,156 | 4/1937 | Perry | 33/493 |
| 2,713,724 | 7/1955 | Sanchez | 33/474 |
| 2,808,652 | 10/1957 | Orlin | 33/474 |
| 3,739,739 | 6/1973 | Brase | 116/240 |
| 4,024,831 | 5/1977 | Sperling | 33/493 |
| 4,221,057 | 9/1980 | Luikart | 33/1 B |
| 4,503,615 | 3/1985 | Schreiber | 33/1 C |

FOREIGN PATENT DOCUMENTS

| | | | |
|---|---|---|---|
| 820790 | 11/1937 | France | 33/480 |
| 1035613 | 8/1953 | France | 33/480 |
| 1288207 | 2/1962 | France | 33/1 B |
| 582453 | 11/1946 | United Kingdom | 434/109 |

*Primary Examiner*—Richard R. Stearns
*Attorney, Agent, or Firm*—Harvey B. Jacobson

[57] ABSTRACT

A guide for use by bookkeepers, accountants, auditors and the like in association with ledger sheets, journals, spread sheets and the like having informational indicia associated in horizontal rows and vertical columns to enable such information to be more accurately and easily read with less chance of error. The guide includes an L-shaped member having an elongated horizontal component and a shorter vertical component both of which have a longitudinally continuous transparent area delineated by beveled red lines with the area externally of the red lines being translucent with the width of the transparent area being substantially equal to the width of horizontal rows of indicia and the width of the vertical transparent area being substantially the same as the width of vertical columns of indicia. The juncture between the transparent areas is provided with a window to enable transcription of indicia on the underlying ledger sheet by inserting a writing instrument through the window. The elongated horizontal component is provided with a living hinge to enable the guide to be folded into a compact condition.

5 Claims, 3 Drawing Figures

10
12
14
16
18
20
22
24
26
28
30
32
34
36
2
3

ACCOUNTING GUIDE

BACKGROUND OF THE INVENTION

1. Field of the Invention

A tool in the form of a guide to assist accountants, bookkeepers or others engaged in reading or transcribing information oriented in horizontal rows and vertical columns with such information including but not limited to numerical indicia. The tool or guide is in the form of an L-shaped member having a relatively long horizontal component and a relatively short vertical component with each of the components including a longitudinally extending transparent viewing area delineated by readily discernible lines with the areas outside of the viewing areas being translucent to facilitate proper orientation of the guide and yet enabling easy and effective observation of the indicia underlying the longitudinal transparent viewing areas. The juncture of the horizontal and vertical components is provided with a cut out in the form of a window to enable information to be transcribed onto an underlying sheet of paper. The tool or guide is preferably constructed of plastic material with the long or horizontal component being provided with a living hinge to facilitate folding into a more compact condition.

2. Information Disclosure Statement

Accurate reading or transcription of indicia when arranged in horizontal rows and/or vertical columns has been and continues to be a problem for persons engaged in such activities as accountants, bookkeepers and the like. Various efforts have been made to alleviate this problem by providing tools, instruments, guides and the like with the following U.S. patents being exemplary of the development in this art.

U.S. Pat. No. 741,140, 10-13-03
U.S. Pat. No. 776,651, 12-6-04
U.S. Pat. No. 1,658,499, 2-7-28
U.S. Pat. No. 3,126,862, 3-31-64
U.S. Pat. No. 3,269,752, 8-30-66
U.S. Pat. No. 3,739,739, 6-19-73
U.S. Pat. No. 4,024,831, 4-24-77

U.S. Pat. No. 3,739,739 discloses an instrument having a transparent area extending longitudinally thereof to assist a reader in reading information oriented in horizontal rows but would not assist a reader or transcriber of data in either accurately reading or writing material associated with a particular horizontal row and/or a particular vertical column.

SUMMARY OF THE INVENTION

An object of the present invention is to provide an accounting guide of L-shaped configuration including an elongated horizontal component and an elongated vertical component with the vertical component being somewhat shorter than the horizontal component with both components including a longitudinally extending transparent area to enable the user to accurately read information associated with a particular horizontal row or vertical column of a ledger, journal, chart or the like.

Another object of the invention is to provide a guide in accordance with the preceding object in which the juncture area between the horizontal and vertical observation areas is provided with a window extending therethrough to enable information to be transcribed by use of a suitable writing instrument inserted through the window for writing on an underlying sheet.

A further object of the invention is to provide a guide in accordance with the preceding objects in which the longitudinal and vertical observation areas are of a width generally corresponding to the width of the horizontal rows of data and vertical columns of data with the transparent areas being delineated by readily distinguishable lines incorporated into the guide to enable the user to easily discriminate between the transparent areas and the remaining areas of the guide.

Still another object of the invention is to provide an L-shaped guide in accordance with the preceding objects constructed of plastic material or the like in which a living hinge is provided in at least the elongated horizontal component to enable it to be easily folded into a more compact condition.

A still further object of the invention is to provide an accounting guide in accordance with the preceding objects which is effective in operation, enables either accurate reading or writing of material associated with a particular horizontal row or vertical column and enables a bookkeeper, accountant or others engaged in similar tasks to more effectively perform their duties.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is a plan view of the accounting guide of the present invention illustrating its association with horizontal rows and vertical columns of numerical indicia such as found on a ledger sheet, journal or the like.

FIG. 2 is a fragmental, detailed sectional view, on an enlarged scale, illustrating the window at the juncture between the horizontal and vertical observation areas.

FIG. 3 is a sectional view taken along section line 3—3 on FIG. 1 illustrating the living hinge structure in the elongated horizontal component of the guide.

DESCRIPTION OF THE PREFERRED EMBODIMENT

Figures 1, 2, 3:
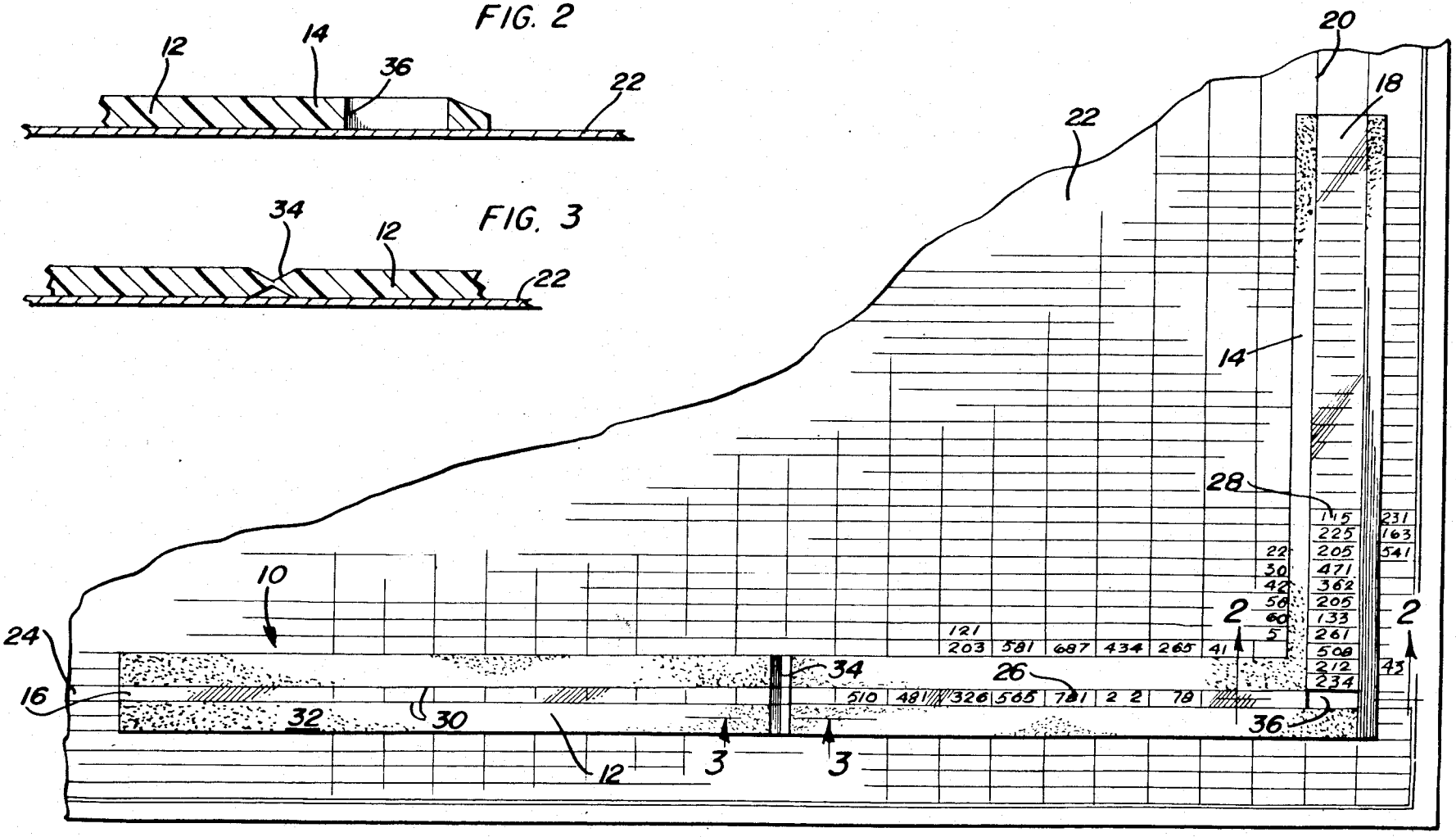

Referring now specifically to the drawings, the accounting guide of the present invention is generally designated by reference numeral 10 and is of L-shaped configuration and includes an elongated horizontal component or blade 12 and an elongated vertical component or blade 14 with the vertical component 14 being substantially shorter than the horizontal component 12 as illustrated in FIG. 1.

The horizontal component 12 includes a longitudinally continuous transparent viewing area 16 and the vertical component 14 includes a longitudinally continuous transparent viewing area 18 with the viewing area 16 being substantially less than the width of the vertical viewing area 18. As illustrated in FIG. 1, the vertical viewing area 18 has a width generally equal to the width of vertical columns 20 in a ledger sheet 22 whereas the horizontal viewing area 16 has a width generally equal to the width of the horizontal rows 24 in the ledger sheet 22 so that indicia 26 in the horizontal rows 24 and the indicia 28 in the vertical columns 20 can be observed through the transparent areas 16 and 18 respectively. The transparent areas 16 and 18 are delineated by parallel readily observable lines 30 which may be in the form of red beveled lines or other distinguishable colored lines in order to clearly delineate the transparent areas 16 and 18. The areas of the components 12 and 14 outwardly of each transparent area 16 and 18 are translucent as indicated by numeral 32 which enables the guide to be easily located in relation to a horizontal row 24 and a vertical column 20 with the translucent areas 32 preventing easy reading of the indicia 26 and 28 underlying those areas but still enabling the guide to be easily positioned in relation to the desired horizontal rows and vertical columns.

The guide 10 is preferably constructed of plastic material and is of unitary, one piece construction. In order to enable the guide to collapse into a more compact condition for easy storage and use, the horizontal component 12 is provided with a "living hinge" 34 which in and of itself is a conventional hinge structure utilized in hingedly connecting plastic components in which the components are of unitary construction by providing depressions forming the hinge axis in a well known manner. By constructing the device of plastic material such as polyethelene and the like, the device may be relatively inexpensively constructed and the translucent portions 32 and the lines 30 may be formed in the material as it is constructed.

At the juncture between the horizontal component 12 and the vertical component 14, an opening or window 36 is provided having one dimension equal to the width of the transparent viewing area 16 and another dimension equal to the width of the vertical viewing area 18 to facilitate observation of the indicia and also enabling indicia such as numerals to be transcribed on the underlying sheet 22.

The dimensional characteristics of the device may vary as may the dimensional characteristics of the transparent areas and the transcribing window with these dimensions conforming with the dimensions of the horizontal rows and vertical columns on existing ledger sheets, journals and the like. Also, the inner edge of the guide may be provided with a red beveled line and the orientation and dimensional characteristics of the transparent viewing areas may be varied for different uses. For example, two parallel transparent viewing areas may be provided in either or both of the horizontal and vertical components and the window 36 may be eliminated in certain uses not requiring transcription of information. The edge corners of the top of the guide are tapered for ease of use and to eliminate sharp edges to facilitate handling and use of the device.

This guide is especially useful in assisting accountants, bookkeepers or others engaged in reading numerical information or other data such as in the format of a ledger sheet, journal, chart or spread sheets and also assists a transcriber of data in accurately writing material associated with the particular row and/or column. Thus, horizontal rows of indicia and vertical columns of indicia can be quickly and accurately read and indicia may be transcribed accurately and quickly in a desired location thereby enabling bookkeepers, accountants, auditors and the like to more proficiently perform their tasks.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A guide for use by accountants, bookkeepers and the like for reading and transcribing data on ledge sheets, journals and the like comprising a generally L-shaped member including a horizontal component and a vertical component, each of said components including a longitudinally continuous, transparent viewing area to enable data appearing in horizontal rows and/or vertical columns underlying the transparent areas to be read, said transparent area in the horizontal component having a width generally equal to the width of the horizontal rows on the ledger sheet, journal and the like, the transparent area in the vertical component having a width generally equal to the width of the vertical columns on the underlying ledger sheet, journal and the like, said transparent areas being delineated by parallel, readily discernible lines, the center line of the transparent areas corresponding with the center line of the components with the areas outwardly of the delineating lines being translucent to facilitate orientation of the guide, the juncture between the horizontal transparent area being provided with an opening forming a window through which data may be transcribed onto the underlying ledger sheet, journal and the like.

2. The guide as defined in claim 1 wherein said components are constructed of plastic material of unitary construction.

3. The guie as defined in claim 2 wherein at least one of said components is provided with a living hinge to enable folding of the guide into compact condition.

4. The guide as defined in claim 3 wherein the horizontal component is substantially longer than the vertical component.

5. The guide as defined in claim 4 wherein said lines delineating the transparent areas are of a distinguishable color, the top edge surfaces of said components tapering downwardly and outwardly to facilitate handling of the guide.

* * * * *